US010182594B2

(12) United States Patent
Lavanant

(10) Patent No.: US 10,182,594 B2
(45) Date of Patent: Jan. 22, 2019

(54) SMOKING ARTICLE WITH DUAL ADDITIVE DELIVERY SYSTEM

(71) Applicant: PHILIP MORRIS PRODUCTS S.A., Neuchatel (CH)

(72) Inventor: Laurent Lavanant, Evian-les-Bains (FR)

(73) Assignee: Philip Morris Products S.A., Neuchatel (CH)

( * ) Notice: Subject to any disclaimer, the term of this patent is extended or adjusted under 35 U.S.C. 154(b) by 162 days.

(21) Appl. No.: 15/102,886

(22) PCT Filed: Dec. 30, 2014

(86) PCT No.: PCT/EP2014/079429
§ 371 (c)(1),
(2) Date: Jun. 9, 2016

(87) PCT Pub. No.: WO2015/101620
PCT Pub. Date: Jul. 9, 2015

(65) Prior Publication Data

US 2016/0302478 A1 Oct. 20, 2016

(30) Foreign Application Priority Data

Dec. 31, 2013 (EP) ..... 13199899

(51) Int. Cl.
*A24D 3/06* (2006.01)

(52) U.S. Cl.
CPC ..... *A24D 3/061* (2013.01); *A24D 3/066* (2013.01)

(58) Field of Classification Search
None
See application file for complete search history.

(56) References Cited

U.S. PATENT DOCUMENTS 3,339,558 A 9/1967 Waterbury
3,366,121 A 1/1968 Carty
(Continued)

FOREIGN PATENT DOCUMENTS

EA 12456 10/2009
EP 0105682 11/1986
(Continued)

OTHER PUBLICATIONS

European Extended Search Report issued for Application No. 13199899.9 dated Jun. 3, 2014 (7 pages).
(Continued)

*Primary Examiner* — Cynthia Szewczyk
(74) *Attorney, Agent, or Firm* — Mueting, Raasch & Gebhardt, P.A.

(57) ABSTRACT

There is provided a smoking article (100) incorporating an additive delivery system. The additive delivery system comprises a frangible capsule (110) comprising a breakable shell containing a liquid core. The shell can be broken by means of a pressure to release a single burst of the liquid core. Further, the additive delivery system comprises a sustained-release liquid delivery material (111) comprising a liquid composition. The liquid composition is releasable in discrete amounts from the liquid delivery material upon compression of the liquid delivery material so as to selectively combine the first and second additive. The frangible capsule and the sustained-release liquid delivery material are spaced apart, such that a consumer can separately and selectively activate the release of additive from either component of the delivery system.

20 Claims, 1 Drawing Sheet

(56) References Cited

U.S. PATENT DOCUMENTS

| | | | | |
|---|---|---|---|---|
| 3,390,686 | A | 7/1968 | Irby, Jr. | |
| 3,428,049 | A | 2/1969 | Leake | |
| 3,530,861 | A | 9/1970 | Carty | |
| 3,547,130 | A | 12/1970 | Harlow | |
| 3,602,231 | A | 8/1971 | Dock | |
| 3,635,226 | A | 1/1972 | Horsewell | |
| 3,685,521 | A | 8/1972 | Dock | |
| 3,916,914 | A | 11/1975 | Brooks | |
| 3,991,773 | A | 11/1976 | Walker | |
| 4,687,008 | A | 8/1987 | Houck, Jr. | |
| 5,724,997 | A | 3/1998 | Smith | |
| 7,578,298 | B2 | 8/2009 | Karles | |
| 7,836,895 | B2 | 11/2010 | Dube | |
| 7,878,962 | B2 * | 2/2011 | Karles | A24D 3/0216 493/47 |
| 7,984,719 | B2 | 7/2011 | Dube | |
| 2003/0098033 | A1 | 5/2003 | Macadam | |
| 2004/0261807 | A1 * | 12/2004 | Dube | A24D 3/061 131/337 |
| 2005/0070409 | A1 | 3/2005 | Deal | |
| 2007/0119467 | A1 | 5/2007 | Akhmetshin | |
| 2008/0163877 | A1 | 7/2008 | Zhuang | |
| 2009/0050163 | A1 | 2/2009 | Hartmann | |
| 2014/0209111 | A1 * | 7/2014 | Russell | A24D 3/0216 131/335 |
| 2014/0290678 | A1 * | 10/2014 | Besso | A24D 3/04 131/337 |
| 2016/0295914 | A1 * | 10/2016 | Jordil | A24D 3/061 |

FOREIGN PATENT DOCUMENTS

| | | |
|---|---|---|
| EP | 0105683 | 1/1987 |
| EP | 0276021 | 8/1993 |
| EP | 0464324 | 12/1994 |
| EP | 0920816 | 6/1999 |
| EP | 1895863 | 12/2009 |
| EP | 2213185 | 11/2011 |
| GB | 1194572 | 6/1970 |
| GB | 1234802 | 6/1971 |
| GB | 2490730 | 11/2012 |
| KZ | 27534 | 10/2013 |
| WO | WO 2003/009711 | 2/2003 |
| WO | WO 2012/156689 | 11/2012 |
| WO | WO 2012/156699 | 11/2012 |
| WO | WO 2012/156708 | 11/2012 |
| WO | WO 2013/068081 | 5/2013 |
| WO | WO 2013/068304 | 5/2013 |
| WO | WO 2013/187245 | 12/2013 |

OTHER PUBLICATIONS

PCT Search Report and Written Opinion for PCT/EP2014/079429 dated Apr. 8, 2015 (10 pages).

Office Action issued in Kazakhstan for Application No. 2016/0654.1 dated Sep. 22, 2017 (11 pages). English translation included.

Office Action issued in the Philippines for Application No. 1-2016-500707 dated Aug. 2, 2018 (3 pages).

Office Action issued in Japan for Application No. 2016-544102 dated Nov. 12, 2018 (12 pages). English translation included.

* cited by examiner

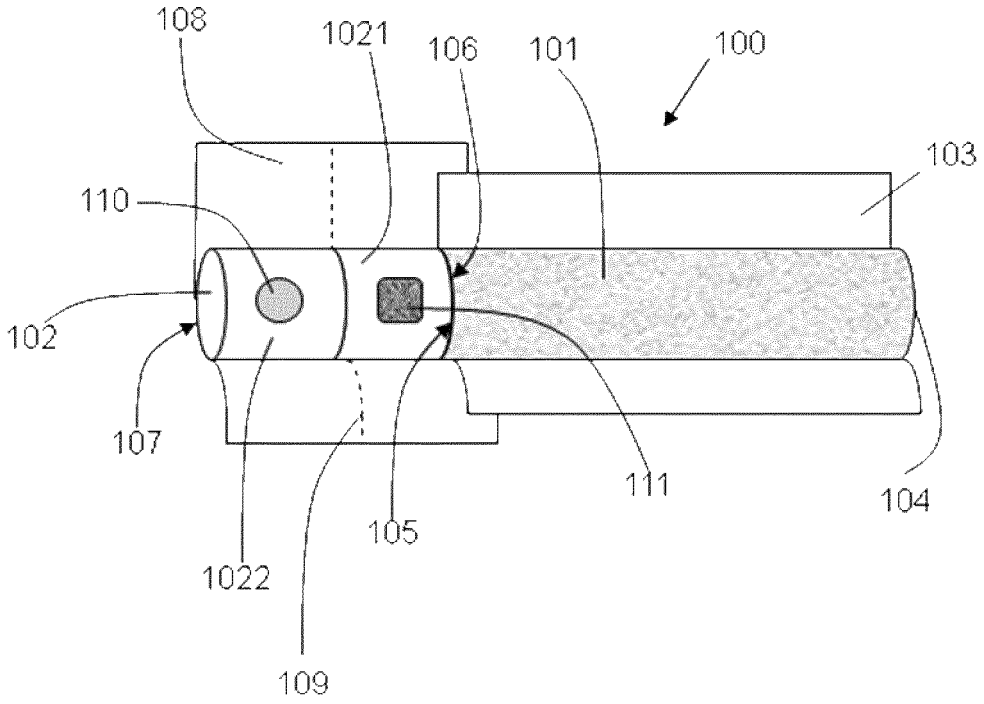
108
1021
106
101
100
103
110
102
107
1022
109
105
111
104

SMOKING ARTICLE WITH DUAL ADDITIVE DELIVERY SYSTEM

This application is a U.S. National Stage Application of International Application No. PCT/EP2014/079429, filed Dec. 30, 2014, which was published in English on Jul. 9, 2015, as International Patent Publication WO 2015/101620 A1. International Application No. PCT/EP2014/079429 claims priority to European Application No. 13199899.9 filed Dec. 31, 2013.

The present invention relates to a smoking article that includes an additive delivery system that provides selective release of a liquid, such as a flavourant, upon compression.

It is well known to incorporate flavourant additives into smoking articles in order to provide additional flavours to the consumer during smoking. Flavourants may be used to enhance the tobacco flavours produced upon heating or combusting the tobacco material within the smoking article, or to provide additional non-tobacco flavours such as mint or menthol.

The flavourant additives used in smoking articles, such as menthol, are commonly in the form of a liquid flavourant which is incorporated into the filter or the tobacco rod of the smoking article using a suitable liquid carrier. Liquid flavourants are often volatile and will, therefore, tend to migrate or evaporate from the smoking article during storage. The amount of flavourant available to flavour the mainstream smoke during smoking is therefore reduced.

It has previously been proposed to reduce the loss of volatile flavourants from smoking articles during storage through the encapsulation of the flavourant, for example, in the form of a capsule or microcapsule. The encapsulated flavourant can be released prior to or during smoking of the smoking article by breaking open the encapsulating structure, for example by crushing or melting the structure. Where such capsules are crushed to release the flavourant, the capsules break open at a particular force and release substantially all of the flavourant at that force.

It has also been previously proposed to encapsulate a flavourant within a matrix material, wherein compression is applied to the matrix material in order to release the flavourant. The flavourant encapsulated within a matrix material may be released more gradually than with a capsule. Unlike with the encapsulating structure of a capsule, the matrix structure does not break open to release all of the flavourant at a particular force but is gradually broken down as the force is sustained.

It is also known to incorporate other types of non-flavourant liquid additives into smoking articles in order to adapt the smoke in some way during smoking. For example, certain liquid additives may be provided within a smoking article filter to alter the filtration properties of the filter during smoking.

It has further been previously proposed to incorporate into a smoking article two or more capsules or microcapsules, each containing a liquid additive, particularly a flavourant. However, because the capsules break open at a particular force to release substantially all the flavourant they contain, only separate bursts of flavour can be obtained when the capsules are broken. It may therefore be difficult for the consumer to tune the intensity of the flavour or to control how the taste will evolve over time.

It would be desirable to provide an improved smoking article incorporating an additive delivery system that makes it possible for the consumer to selectively tune and control the amount of additive released into the mainstream smoke. In particular, where the additive is a flavourant, it would be desirable to provide an improved smoking article incorporating a flavour delivery system that enables to consumer to control the evolution of the taste perceptions during the smoking experience. Further, it would be desirable to provide such a smoking article that is straightforward and inexpensive to manufacture.

According to the invention, there is provided a smoking article incorporating an additive delivery system, the additive delivery system comprising: a frangible capsule comprising a breakable shell containing a liquid core comprising a first additive, wherein the shell can be broken by means of a pressure to release a single burst of the liquid core; and a sustained-release liquid delivery material comprising a liquid composition containing a second additive, wherein the liquid composition is releasable in discrete amounts from the liquid delivery material upon compressions of the liquid delivery material so as to selectively combine the first and the second additive. The frangible capsule and the sustained-release liquid delivery material are spaced apart, such that a consumer can separately and selectively activate the release of additive from either component of the frangible capsule and the sustained-release liquid delivery material.

According to the invention, there is further provided a filter for a smoking article comprising an additive delivery system as defined above.

In the following description, any references to the features or properties of the smoking articles according to the invention also apply to the filters according to the invention, unless stated otherwise.

Smoking articles according to the present invention incorporating the sustained-release liquid delivery material may be in the form of filter cigarettes or other smoking articles in which tobacco material is combusted to form smoke. The present invention additionally encompasses smoking articles in which tobacco material is heated to form an aerosol, rather than combusted, and smoking articles in which a nicotine-containing aerosol is generated from a tobacco material, tobacco extract, or other nicotine source, without combustion or heating. Smoking articles according to the invention may be whole, assembled smoking articles or components of smoking devices that are combined with one or more other components in order to provide an assembled device for producing an aerosol, such as for example, the consumable part of a heated smoking device.

As used herein, the term "smoke" is used to describe smoke produced by combustible smoking articles, such as filter cigarettes, and aerosols produced by non-combustible smoking articles, such as heated or non-heated smoking articles of the types described above.

In this specification, the "upstream" and "downstream" relative positions between smoking article components are described in relation to the direction of mainstream smoke as it is drawn from a lit end of the smoking article through the filter component. Smoking articles as described herein comprise a downstream end and an opposed upstream end. In use, a user draws on the downstream end of the smoking article. The downstream end, which is also described as the mouth end, is downstream of the upstream end, which may also be described as the distal end or the lit end.

As used herein, the term "liquid" refers to compositions that are in a liquid state at room temperature (22 degrees Celsius).

The term "liquid composition" refers to any liquid agent that can be incorporated into a component of an aerosol generating device in order to provide an effect on the smoke. The liquid composition may be, for example, a substance that is capable of reducing one or more constituents of the aerosol. Alternatively, the liquid composition may be a substance that is capable of reacting with one or more other substances in the aerosol generating device to produce an aerosol. In preferred embodiments of the invention, the liquid composition is a liquid flavour composition and the liquid delivery material is adapted for providing flavour in a smoking article or a portion of a smoking article.

In the following, the invention will be described with particular reference to a delivery system that provides release of a flavour composition. However, the teaching can also be applied to a delivery system for the release of other alternative additives.

Throughout this specification, the expression "single-burst release" is used to indicate that the frangible capsule is designed to break and release its content upon application of a compressive force (crushing strength). In practice, when the frangible capsule is broken, most of the additive contained in the liquid core is released at once in that all of the additive is exposed to smoke that may be passing by the capsule; in this manner, substantially no further release of additive from the same capsule can be triggered by the user. Accordingly, the concentration of additive in the mainstream smoke increases very rapidly to reach a peak value, only to progressively diminish with time during smoking of the smoking article.

In embodiments where the additive is a flavourant, the expression "single-burst release" is also used to indicate the sudden perception by the consumer of an intense flavour in the mainstream smoke. The flavour intensity reaches very quickly a maximum and then becomes progressively less noticeable.

On the other hand, the term "sustained release" is used to indicate that the additive delivery material is capable of releasing the additive-containing composition over a range of applied compressive force, over a range of deformation of the material, or both. For example, if the release of the additive-containing composition as a function of the applied compressive force is measured, it will be seen that the material is capable of releasing the additive-containing composition at a force of x Newton and will continue to release the flavour composition as the force is increased from x Newton to (x+y) Newton (for example, where y is 5 Newton).

Because they are ranges, the ranges of force and deformation described herein have a width and they extend between the ends of the ranges. For example, using the generic example above where y is 5 Newton, the range of force would have a width of 5 Newton and it would extend from x Newton to (x+5) Newton.

Since increasing the compressive force over the range of force will release further additive from the additive delivery material, the term "sustained release" can also be described as "progressive release". This is in contrast to other known additive release mechanisms for smoking articles in which an additive, such as a flavourant, is released at a particular force, but not released prior to or after the particular force.

Those of skill in the art will understand that the term "sustained release" covers those embodiments in which the amount of additive released at a given force depends additionally on the duration of the applied force. For example, in some embodiments, two brief applications of a given force may release the same amount of additive composition as a single, extended application of the given force. In these embodiments, it is possible to use the sustained release properties of the material to provide multiple "doses" of the additive-containing composition by repeatedly applying the same or similar force to the additive delivery material. In addition, multiple applications of progressively higher forces can also be used, which in some cases can increase the amount of additive in the multiple "doses" that are released.

Throughout the specification, the term "combine" is used to indicate that both first and second additive, regardless of whether they are released simultaneously or at different times, are exposed to the mainstream smoke. Therefore, combined properties are imparted to the smoke that differ from those which would be imparted by either additive alone. In general, the first and the second additive will combine in the smoke. In some embodiments, the first and second additive may combine, at least to some extent, even before reaching the smoke.

In particular, where the first additive and the second additive are the same additive, the term "combine" is used to mean that both, typically different, amounts of the same additive released from the frangible capsule and the sustained-release delivery material together affect the mainstream smoke. Accordingly, in the case where the same additive is a flavourant, the consumer's taste perception shall be more intense than it would be if only one of the two amounts of flavourant had been released.

On the other hand, where the first additive and the second additive are different additives, the term "combine" is used to mean that the two additives synergistically impact on the properties of the mainstream smoke. In particular, in this case, the term "combine" is used to mean that by adjusting the amount of second additive released from the sustained-release delivery material, the relative proportion of the first and the second additive in the mixture can be selectively varied by the user. Accordingly, in the case where the first and the second additives are two different flavourants, the consumer's taste perception shall be affected, at once, by both flavourants. Further, the consumer's taste perception shall evolve with time, for example depending on the sustained-release dynamics of the second additive triggered by the consumer.

Smoking articles of the present invention incorporate a novel additive delivery system that provides, in combination, a frangible capsule adapted to release in a single burst a first amount of a first additive and a sustained-release delivery system adapted to release a second, generally smaller, amount of a second additive. The frangible capsule and the sustained-release liquid delivery material are distinct from one another and spaced apart. Thus, a consumer can separately and selectively activate the release of additive from either of the frangible capsule and the sustained-release liquid delivery material. Accordingly, the consumer may advantageously choose whether and when to independently activate the release of the two additives, which have thus different delivery dynamics and independent release mechanisms. Therefore, by contrast to existing additive delivery systems, the first and the second additive may advantageously be released and combined to provide novel flavouring effects and dynamics, which the consumer may tailor to his or her preferences, as shall be explained in more detail below.

The first and second additive may be the same additive or two different additives. In particular, the first and second additive may be the same flavourant or two different flavourants.

Advantageously, in those embodiments where the first and second additive are the same flavourant, the consumer may easily tune the overall flavour intensity perceived in the mainstream smoke by selectively varying the timing and intensity of release of flavourant from the sustained-release delivery material. For example, the consumer can selectively feed fresh flavourant from the sustained-release delivery material into the mainstream smoke, once the burst of flavour triggered by breaking the frangible capsule has begun to wane. The additive delivery system in the smoking article of the invention is therefore advantageously capable of restoring on demand at least part of the flavour intensity lost after a burst release.

Alternatively, the consumer can first activate the sustained-release delivery material to release the desired, variable amount of flavourant into the mainstream smoke, and produce a burst of flavour by breaking the frangible capsule at a later time, for example towards the end of the smoking experience.

On the other hand, in those embodiments where the first and second additive are two different flavourants, the consumer may conveniently vary the timing and intensity of release of the two flavourants and therefore adjust their relative proportion in the mainstream smoke, for example by applying more or less pressure on the sustained-release delivery material at different times, once the frangible capsule has been broken.

Thus, the smoking articles of the present invention advantageously provide a whole range of novel sensory perceptions, which the consumer can selectively access and modify by applying different forces on the delivery system at different times. In particular, the consumer can decide whether and when to release either additive. Therefore, in those embodiments where the two additives are both flavourants, the consumer can advantageously customise the evolution of the flavour over time to his or her own taste.

In some embodiments of the smoking article according to the invention, the frangible capsule is arranged upstream of the sustained-release delivery material. In other embodiments, the frangible capsule is arranged downstream of the sustained-release delivery material.

Because the frangible capsule and the sustained-release delivery material are spaced apart, it is easy for the consumer to separately and selectively activate the release of additive from either component of the delivery system. For example, the frangible capsule and the sustained-release delivery material may be each provided in respective first and second filter segments. This is advantageous because, during manufacturing, each component of the additive delivery system may be separately and independently inserted into a respective, distinct filter segment. The two (or more) filter segments are subsequently assembled together when forming the filter, for example by being attached to one another in end to end arrangement by a single filter wrapper. As an alternative, each filter segment may have a respective filter wrapper, and the two (or more) wrapped filter segments are attached to one another by a band of tipping paper, which is also used to attach the filter to a tobacco rod. The length of each filter segment shall be selected so as to provide a sufficient distance between the frangible capsule and the sustained-release delivery material for the consumer to be able to compress either independently. Further details about the configuration and materials of the filter shall be provided below.

Preferably, the frangible capsule and the sustained-release delivery material are spaced at least about 5 mm apart in the longitudinal direction. More preferably, the frangible capsule and the sustained-release delivery material are spaced at least about 10 mm apart in the longitudinal direction. In a preferred embodiment, the frangible capsule and the sustained-release delivery material are spaced about 13.5 mm apart in the longitudinal direction.

Alternatively or in addition, the frangible capsule and the sustained-release delivery material are preferably spaced at most about 20 mm apart, more preferably at most about 18 mm apart, in the longitudinal direction.

The frangible capsule of the additive delivery system of the smoking article of the invention is configured to act as a single-burst release component. In other words, it is configured to release substantially all of the content of first additive upon application of a given force on the capsule. The frangible capsule comprises a breakable outer shell and an inner liquid core. A larger capsule shall include a proportionately thicker outer shell. Such a shell is relatively straightforward to manufacture consistently and with the desired crush strength.

The capsule may have any suitable structure in which a structural material encloses the liquid core. The capsule may be formed in a variety of physical formations including, but not limited to, a single-part capsule, a multi-part capsule, a single-walled capsule, a multi-walled capsule, a large capsule, and a small capsule. Preferably, the outer shell is substantially continuous, in other words seamless. Preferably, the outer shell is sealed before the application of the external force, but is frangible or breakable to allow the liquid core to be released when the external force is applied.

Provision of a capsule which releases its liquid core when the filter is subjected to an external force allows the first additive to be controllably released by the consumer. The external force may be applied, and hence the additive released, prior to or during use of the smoking article. The external force on the frangible capsule allows the first additive to escape from the capsule and interact with and modify the characteristics of the smoking article and thus the smoke derived therefrom. Because the first additive is only released when an external force is applied to the filter, this reduces the chance of the first additive migrating or disintegrating, for example, during storage.

The frangible capsule may have a crush strength in the range from about 5 Newton to about 25 Newton. Preferably, the frangible capsule has a crush strength in the range from about 8 Newton to about 20 Newton, more preferably from about 11 Newton to about 17 Newton.

The crush strength of the capsule is measured by continuously applying an increasing vertical load on the capsule until the outer shell breaks. For example, a texturometer in compression mode can be used for the measurement. Measurements are taken at room temperature and 65 percent relative humidity. The maximum load applied at the very moment when the capsule is ruptured is taken as the crush strength.

Preferably, the volume of liquid core, and therefore the amount of liquid released upon rupture of the shell is in the range from about 5 microlitres to about 45 microlitres. More preferably, the volume of liquid core is in the range from about from 10 microlitres to about 20 microlitres.

The liquid core of the capsule is considered to be "released" in a single burst when the shell containing the liquid core is broken apart such that its content is exposed to the surrounding environment. Some of the released liquid core may immediately escape from the broken shell as a result of the applied compressive force. In addition, some of the released liquid core may initially remain within the broken shell but gradually migrate out of the shell.

The capsule may have any desired size, as long as a cross sectional area of the capsule measured perpendicular to the longitudinal direction of the filter is greater than about 25% of the cross sectional area of the filter segment. For example, the capsule may be spherical with a diameter between about 2.5 mm and about 4.5 mm, preferably about 3.5 mm. In other embodiments, the capsule may be spherical with a diameter between about 3.0 mm and about 4.0 mm. Further, in some other embodiments, the capsule may be spherical with a diameter between about 2.5 mm and about 3.5 mm. Small capsules may present a number of manufacturing challenges. By using a capsule having a cross sectional area greater than about 25 percent of the cross sectional area of the filter segment, such manufacturing challenges may be avoided in some embodiments. A larger capsule, relative to the filter segment, maximises the amount of first additive enclosed within the capsule and, where the first additive is a flavourant, may achieve a desired flavour level for a consumer.

The capsule may have any suitable shape, for example, spherical, spheroid, or ellipsoid. Preferably, however, the capsule is generally spherical. This may include capsules having a sphericity value of at least about 0.9, and preferably a sphericity value of approximately 1. Sphericity is a measure of how spherical an object is. By definition, the sphericity $\Psi$ of an object is the ratio of the surface area of a sphere having the same volume as the given object to the surface area of the object, as expressed by the formula given below:

$$\Psi=\pi^{1/3}\cdot(1/A_p)\cdot(6V_p)^{2/3}$$

wherein $V_p$ is the volume of the object and $A_p$ is the surface area of the object.

Accordingly, a perfect sphere has a sphericity value of 1. Preferably, the generally spherical capsule comprises a generally spherical outer shell.

The capsule may be manufactured according to any suitable method (for example, by co-extrusion), as will be appreciated by those skilled in the art.

In a preferred embodiment, only a single capsule is incorporated in the smoking article. However, additional capsules may be provided in the longitudinal direction of the filter. The additional capsules may be provided in the same filter segment or in additional filter segments. If additional capsules are provided in the filter, they may have the same or different properties as one another.

The capsule may comprise any suitable material or combination of materials, for example those used in capsules for drug delivery, liquid encapsulated capsules, or other encapsulated materials. By way of example, a capsule typically utilized in the pharmaceutical industry may be used. Such capsules may be gelatin based, for example, or may be formed from a polymeric material, such as modified cellulose. One type of modified cellulose which may be used is hydroxypropylmethyl cellulose. Alternatively, or in addition to one or both gelatin and modified cellulose, the outer shell may comprise polysaccharide.

Preferably, the capsule is a flavourant capsule. Accordingly, the liquid core contained in the breakable shell comprises a flavourant as the first additive, typically mixed with one or more fats that are liquid at room temperature (22 degrees Celsius).

The flavourant may comprise any flavour compound or tobacco extract suitable for being releasably disposed in liquid form within the capsule to enhance the taste of mainstream smoke produced during smoking of a smoking article. Suitable flavours or flavourings include, but are not limited to, menthol, mint, such as peppermint and spearmint, chocolate, liquorice, citrus and other fruit flavours, gamma octalactone, vanillin, ethyl vanillin, breath freshener flavours, spice flavours such as cinnamon, methyl salicylate, linalool, bergamot oil, geranium oil, lemon oil, ginger oil, and tobacco flavour. Other suitable flavours may include flavour compounds selected from the group consisting of an acid, an alcohol, an ester, an aldehyde, a ketone, a pyrazine, combinations or blends thereof and the like. Most preferably, the flavour is a mint or menthol flavour.

The sustained-release liquid delivery material is preferably provided as a liquid delivery material comprising a closed matrix structure defining a plurality of domains and a liquid composition containing a second additive. The liquid composition is trapped within the domains and releasable in discrete amounts from the closed matrix structure, for example upon successive compressions of the liquid delivery material, as described above. Upon compression of the sustained-release liquid delivery material, the additive-containing liquid composition is forced out from the matrix structure, for example, through the localised breakage of the surrounding structure.

The additive-containing liquid composition is considered to be "released" when the structure of the domain containing the liquid composition is broken apart such that the domain is open to the surrounding environment. Some of the released liquid composition may immediately escape from the sustained-release delivery material as a result of the applied compressive force. In addition, some of the released flavour composition may initially remain within the space of the domain but gradually migrate out of the domain through any openings in the domain structure.

Typically, when the flavour delivery material is in place within the smoking article, the compression of the material by the consumer will only initially result in the rupture of a portion of the domains. The remainder of the domains therefore remain closed with the additive-containing liquid composition trapped inside until a further compressive force is applied. The domain structure is therefore particularly well adapted to provide an additive delivery material for multiple releases of additive during smoking.

The closed matrix structure of the sustained-release delivery material comprises a three-dimensional structural polymer matrix that forms a network defining the plurality of domains. The term "domain" is used throughout the present specification to refer to the closed pores or pockets that contain the additive-containing composition or the distinct regions or, for certain manufacturing processes for matrix materials, droplets of the additive-containing composition that are dispersed within the precursor materials of the polymer matrix, as further described below. The additive-containing liquid composition is dispersed through the polymer matrix in a plurality of discrete domains which are surrounded and enclosed by the polymer matrix.

The polymer matrix of the sustained-release delivery material isolates the additive-containing liquid composition so that the additive is substantially retained within the structure of the polymer matrix until the delivery material is compressed. Compression of the delivery material results in deformation of the polymer matrix. As the level of applied force, deformation, or both force and deformation increases, the matrix is gradually broken down and the domains begin to rupture, such that the additive-containing composition retained within the domains is released.

The polymer matrix of the sustained-release delivery material may be formed of one or more cross-linked polysaccharides. The cross-linking of the polymer matrix may be achieved through reaction of the polysaccharides with multivalent cations which form salt bridges to cross-link the polysaccharides.

The sustained-release delivery material may be provided within smoking articles according to the invention in a variety of different forms. In certain embodiments the sustained-release delivery material is provided in the form of beads. The beads may be formed into any suitable shape, but are preferably substantially cylindrical or spherical.

The width of the beads of sustained-release delivery material may be greater than about 1 mm, preferably greater than about 2 mm, and more preferably greater than about 3 mm. Alternatively or in addition, the width of the beads may be less than about 8 mm, preferably less than about 6 mm, and more preferably less than about 4 mm. Preferably, the width of the beads is between about 1 mm and about 8 mm, more preferably between about 2 mm and about 6 mm, even more preferably between about 3 mm and about 4 mm.

The "width" of the beads of the sustained-release delivery material corresponds to the maximum dimension of the transverse cross section of the bead, wherein the transverse cross section refers to the cross section taken through a bead that is in place within a smoking article in a direction substantially perpendicular to the longitudinal axis of the smoking article. For a substantially spherical bead, the width of the bead substantially corresponds to the diameter of the bead.

A single bead of sustained-release delivery material may be provided within the smoking article, or a plurality of beads may be provided, for example two or more, three or more, or four or more beads. Where a plurality of beads is provided, the beads may be spaced apart along the smoking article, or may be placed in one or more specific regions of the smoking article, for example within the filter. The person of ordinary skill in the art shall appreciate that one or more beads of sustained-release delivery material can be inserted into the smoking articles according to the invention using known apparatus and methods for inserting objects into filters or tobacco rods.

Alternatively, the sustained-release delivery material may be in the form of strips or flakes, which can be distributed through the materials forming one or more components of the smoking article, or at one or more desired locations along the smoking article.

Alternatively again, the sustained-release delivery material may be in the form of an elongate filament or yarn, which can be introduced into a component of the smoking article, such as the filter or mouthpiece. A continuous filament may be provided along the full length of one or more of the smoking article components during manufacture, or individual pieces of the filament may be deposited at one or more desired locations along the one or more components. The filament preferably has a width of greater than about 1 mm, preferably greater than about 2 mm, and more preferably greater than about 3 mm. Alternatively or in addition, the width of the filament may be less than about 8 mm, preferably less than about 6 mm, and more preferably less than about 4 mm. Preferably, the width of the filament is between about 1 mm and about 8 mm, more preferably between about 2 mm and about 6 mm, even more preferably between about 3 mm and about 4 mm.

As described above with reference to beads, the "width" corresponds to the maximum dimension of the transverse cross section of the filament, wherein the transverse cross section refers to the cross section taken through a filament that is in place within a smoking article in a direction substantially perpendicular to the longitudinal axis of the smoking article.

$D_C$ is taken to be the diameter of the frangible capsule. $D_{SR}$ is taken to be the width of the bead of sustained-release delivery material. $D_{SA}$ is taken to be the diameter of the smoking article. Preferably, the $D_C/D_{SA}$ ratio and the $D_{SR}/D_{SA}$ ratio are both from about 0.30 to about 0.65, with both $D_{SR}$ and $D_{SA}$ being from about 2.5 mm to about 5 mm. In a preferred embodiment, the diameter of the smoking article $D_{SA}$ is 7.85 mm, the diameter of the frangible capsule $D_C$ is 3.5 mm and the width of the bead of sustained-release delivery material $D_{SR}$ is 4.2 mm.

Preferably, with a compression of the sustained-release delivery material, depending on the entity of the force applied, volumes ranging from about 10 percent to about 50 percent of the volume of liquid composition available in the sustained-release delivery material are released.

Preferably, the liquid delivery material provides a sustained release of the liquid composition upon compression of the material over a range of force of at least 5 Newtons.

Preferably, the liquid delivery material provides a sustained release of the liquid composition upon compression of the material over a range of force from about 1 Newtons to about 40 Newtons. More preferably, the liquid delivery material provides a sustained release of the liquid composition upon compression of the material over a range of force from about 10 Newtons to about 15 Newtons.

Preferably, the discrete amount of liquid composition released upon each single compression of the liquid delivery material is smaller than the volume of liquid core released upon rupture of the shell.

Preferably, the discrete amount of liquid composition released upon a single compression of the sustained-release liquid delivery material is from about from about 1 microlitre to about 10 microlitres.

It is assumed that most, if not all of the weight loss exhibited upon compression or deformation of the sustained-release liquid delivery material is as a result of the release of the additive-containing composition from the material. The amount of additive-containing composition released from the material can therefore be determined by measuring the difference in the weight of the sustained-release liquid delivery material before and after compression and calculating the percentage reduction in the total weight of the sustained-release liquid delivery material. As defined above, the weight loss is calculated with reference to the initial weight of the sustained-release liquid delivery material prior to any compression.

In certain embodiments, the flavour delivery material of the smoking articles of the present invention may passively release a low level of the flavour composition over time in the absence of an applied compressive force. For example, during production of the flavour delivery material, a small amount of the flavour composition may not be effectively trapped within the flavour delivery material and may therefore remain on the surfaces of the material. This small amount of residual flavour composition is therefore immediately available for contact with the smoke. In this way, a low base level of flavour can be provided during smoking even without compression of the flavour delivery material to release the flavour composition. Upon compression of the flavour delivery material, the same flavour is maintained but with an increased intensity.

In some embodiments, the second additive contained in the sustained-release delivery material is the same as the first additive contained in the frangible capsule. Thus, the user may adjust the overall release dynamics of the additive into the mainstream smoke by selectively causing the sustained-release liquid delivery material to release some of the additive before or after breaking the frangible capsule to release a single burst of the additive.

In other embodiments, the second additive is different from the first additive. Thus, by selectively causing the sustained-release liquid delivery material to release some of the second additive after breaking the frangible capsule to release a single burst of the first additive, the user may for example form a mixture of the first and second additives to contact the mainstream smoke, or vary the relative proportion of the first and second additives in the mixture already interacting with the mainstream smoke. This is particularly advantageous when the first and the second additive are two different flavourants.

Preferably, the sustained-release delivery material is a flavour release material. Accordingly, the second additive contained in the liquid composition is a flavourant, which is typically mixed with one or more fats that are liquid at room temperature (22 degrees Celsius).

As was described before with reference to the frangible capsule, the flavourant may comprise any flavour compound or tobacco extract suitable for being releasably disposed in liquid form within the capsule to enhance the taste of mainstream smoke produced during smoking of a smoking article containing the additive delivery system.

Smoking articles according to the present invention may incorporate the additive delivery system in any one or more of the components of the smoking article. The smoking article component or portion of the component incorporating the additive delivery system should be deformable, such that a compressive force can be applied to the additive delivery system through the compression of the component.

Preferably, the additive delivery system is incorporated into the filter or mouthpiece of the smoking article. The filter or mouthpiece may be compressed in order to apply a compressive force to the additive delivery system to selectively release either of the first and the second additive into the surrounding filter material. During smoking of the smoking article, the additive or additives from the portion of liquid core and additive-containing liquid composition that has been released from the additive delivery system is delivered into the smoke that passes through the filter.

The filter may be a single segment filter, formed of a single segment incorporating the additive delivery system. Alternatively, the filter may be a multi-component filter comprising at least one filter segment incorporating the additive delivery system and at least one additional filter segment.

In other, preferred embodiments of the invention, the filter comprises at least two segments, each of which incorporates one of the frangible capsule and the sustained-release delivery material, respectively. Further, the filter may comprise at least one additional filter segment.

In particular, the frangible capsule or the sustained-release delivery material may be incorporated within a segment of a fibrous filtration material, such as cellulose acetate tow. In such embodiments, either component of the delivery system is preferably dispersed through the fibrous filtration material during production of the filter segment, such that in the assembled filter, the component is embedded within the segment. Upon compression of the filter and of either component of the delivery system within the filter, the liquid core or the liquid-containing additive is released into the surrounding fibrous filtration material. Advantageously, where the additive composition is a flavour composition comprising a liquid excipient, such as one or more liquid fats, the additive composition is readily dispersed amongst the fibrous filtration material upon release from either component of the delivery system. The liquid core or liquid additive-containing composition thereby coats the fibres of the filtration material to optimise the transfer of the flavourants into the smoke.

In alternative embodiments of the invention, the additive delivery system is incorporated within a cavity in the filter. For example, the flavour delivery system may be incorporated within a cavity between two filter plugs, wherein the cavity is defined by a filter wrapper surrounding the filter.

The frangible capsule or the bead of sustained-release material may be located symmetrically or asymmetrically within the filter segment. If the capsule or bead is located symmetrically within the filter segment, the centre of the capsule or bead is equidistant between the upstream and downstream ends of the filter segment.

If the filter includes additional elements and the placement of the capsule or bead is symmetric with respect to the whole filter, the placement of the capsule or bead may be either symmetric or asymmetric with respect to the filter segment, depending on the position and length of the additional filter elements.

If the capsule or bead is located asymmetrically within the filter segment, the centre of the capsule or bead is not equidistant between the upstream and downstream ends of the filter segment. For example, the capsule or bead may be located in the upstream third of the filter segment or in the downstream third of the filter segment. If the filter includes additional elements and the placement of the capsule or bead is asymmetric with respect to the whole filter, the placement of the capsule or bead may be either symmetric or asymmetric with respect to the filter segment, depending on the position and length of the additional filter elements.

The additive delivery system within the filter may be visible to the consumer through the one or more layers of wrapping material circumscribing the filter. Suitable arrangements for providing a filter with visibility of the filter material would be known to the skilled person.

A variety of suitable filter segments would be well known to the skilled person including but not limited to fibrous filter tows, cavity filter segments, tubular filter segments and flow restrictor segments. One or more of the filter segments may comprise an additional flavour material, a sorbent material, or a combination of a flavour material and a sorbent material.

The filter material (of the filter segment or any additional filter elements) may comprise any suitable material or materials. Examples of suitable materials include, but are not limited to, cellulose acetate, cellulose, reconstituted cellulose, polylactic acid, polyvinyl alcohol, nylon, polyhydroxybutyrate, polypropylene, paper, thermoplastic material, such as starch, non-woven materials and combinations thereof. One or more of the materials may be formed into an open cell structure. Preferably, the filter material comprises cellulose acetate tow.

The filter may include additional material, either in the filter segment or in one or more additional elements incorporated in the filter. For example, the additional material may be incorporated into fibrous filter tow of the filter segment or an additional filter element. For example, the filter may include a sorbent material. The term "sorbent" refers to an adsorbent, an absorbent, or a substance that may perform both of these functions. The sorbent material may comprise activated carbon. The sorbent may be incorporated into the filter segment in which the capsule is embedded. More preferably, however, the sorbent is incorporated into an additional filter element upstream of the filter segment. Alternatively or additionally, the filter may include an adhesive, a plasticiser or flavour release agent, or a combination thereof.

If a sorbent material, such as activated carbon, is provided in the filter, either in the filter segment in which the additive delivery system is embedded or in an additional filter element, preferably the additive delivery system is downstream of the sorbent material. Such an arrangement allows for the filtration of the smoking article to be effected by the sorbent, and for the liquid additive or additives to be released into the filter without the effectiveness of the liquid additive or additives being affected by absorption or adsorption by the sorbent.

Filters according to the present invention may advantageously be used in filter cigarettes and other smoking articles in which tobacco material is combusted to form smoke. The cigarette therefore typically contains two sections: the tobacco-containing portion, typically a tobacco rod, and the filter. Tipping paper typically surrounds the filter, which forms the mouth end of the cigarette. The tipping paper overlaps with the tobacco rod in order to hold the filter and tobacco rod together. The tobacco rod typically includes the paper wrapper in which the tobacco is wrapped and the adhesive holding the seams of the paper wrapper together. The tobacco rod has a first end which is attached to the filter and a second end which is lit or heated for smoking the tobacco. When the tobacco rod is lit or heated for smoking, the smoke travels from the lit end downstream to the filter end of the tobacco rod and further downstream through the filter.

The tipping material may include a ventilation zone comprising perforations through the tipping material. The degree of ventilation is preferably above about 40 percent, more preferably above about 60 percent, even more preferably above about 80 percent. The degree of ventilation is preferably less than about 95 percent, more preferably less than about 90 percent, even more preferably less than about 85 percent. The degree of ventilation is preferably between about 60 percent and about 95 percent, more preferably between about 70 percent and about 90 percent, even more preferably between about 80 percent and about 85 percent. Smoking articles having high levels of ventilation may have RTD levels which are too low to be considered acceptable to a consumer. However, with the addition of the embedded additive delivery material in the filter which, because of its relatively high cross sectional area results in a larger RTD, the filter may have the desired RTD level. If used with high ventilation, the additive delivery material can increase RTD while both the particulate phase and the gas phase constituents of the mainstream smoke are reduced.

The tipping material may include at least one row of perforations to provide ventilation of the mainstream smoke. If the filter includes a filter wrapper, preferably, the perforations extend through the filter wrapper. Alternatively, the filter wrapper may be permeable. The tipping material may be standard pre-perforated tipping material. Alternatively, the tipping material may be perforated (for example, using a laser) during the manufacturing process according to the desired number, size and position of the perforations. The number, size and position of the perforations may be selected to provide the desired level of ventilation.

In certain preferred embodiments, the at least one row of perforations is provided between the frangible capsule and the sustained-release delivery material. This is advantageous especially in those embodiments where each component of the additive delivery system is embedded in a distinct filter segment, because it may simplify the manufacturing process.

Alternatively, the at least one row of perforations may be provided upstream of both the frangible capsule and the additive delivery system. This advantageously reduces the chance of liquid additive leaking out of the perforations after the liquid additive is released.

Preferably, the at least one row of perforations is at least about 10 mm upstream of the mouth end of the filter. More preferably, the at least one circumferential row of perforations is at least about 12 mm upstream of the retaining element.

Preferably, the overall length of smoking articles according to the present invention is between about 70 mm and about 128 mm, more preferably about 84 mm.

Preferably, the external diameter of smoking articles according to the present invention is between about 5 mm and about 8.5 mm, more preferably between about 5 mm and about 7.1 mm for slim sized smoking articles or between about 7.1 mm and about 8.5 mm for regular sized smoking articles.

Preferably, the overall length of the filters of smoking articles according to the present invention is between about 18 mm and about 36 mm, more preferably about 27 mm. Smoking articles according to the present invention may be packaged in containers, for example in soft packs or hinge-lid packs.

The invention will be further described, by way of example only, with reference to the accompanying FIG. 1, which is a schematic perspective view of a smoking article according to an embodiment of the present invention.

Reference numeral 100 in FIG. 1 identifies a smoking article according to an embodiment of the present invention. The smoking article 100 includes a generally cylindrical tobacco rod 101 and a generally cylindrical filter 102. The tobacco rod 101 and filter 102 are axially aligned in an end-to-end relationship, preferably abutting one another. The tobacco rod includes an outer wrapper 103 circumscribing the smoking material. The outer wrapper 103 may be a porous wrapping material or paper wrapper. The tobacco is preferably a shredded tobacco or tobacco cut filter. The tobacco rod 101 has an upstream, lit end 104 and a downstream end 105. The filter 102 has an upstream end 106 and a downstream, mouth end 107. The upstream end 106 of the filter 102 is adjacent the downstream end 105 of the tobacco rod 101.

The filter 102 is attached to the tobacco rod 101 by tipping material 108 which circumscribes the entire length of the filter 102 and an adjacent region of the tobacco rod 101. The tipping material 108 is shown partially removed from the smoking article in FIG. 1, for clarity. The tipping material 108 is typically a paper-like product. However, any suitable material can be used. In this embodiment, the tipping material 108 includes a circumferential row of perforations 109 aligned with the filter 102. The perforations are provided for ventilation of the mainstream smoke.

In this specification, the "upstream" and "downstream" relative positions between smoking article components are described in relation to the direction of mainstream smoke as it is drawn from the tobacco rod 101 and through the filter 102.

The filter component 102 comprises a first segment 1021 and a second segment 1022 upstream of the first segment 1021. The first segment 1021 has a length of 12 mm. The second segment 1022 has a length of 15 mm. The first segment **102*a* incorporates a frangible capsule 110 of the type comprising a breakable shell containing a liquid core. The shell can be broken by means of a pressure to release a single burst of the liquid core. In this embodiment, the frangible capsule contains 20 microlitres of liquid core. In more detail, the liquid core contains a liquid flavourant as the first additive, for example a "mint" flavourant. The distance between the mouth-end of the filter component 102 and the frangible capsule 110** is 7.5 mm.

The second segment 1022 incorporates a sustained-release liquid delivery material 111 comprising a liquid composition. In this embodiment, the sustained-release liquid delivery material is provided as a matrix bead containing 10 microlitres of liquid composition. In more detail, the liquid composition contains a liquid flavourant as the second additive. The second additive is different from the first additive, for example it is a "floral" flavourant. The distance between the mouth-end of the filter component 102 and the sustained-release liquid delivery material 111 is 21 mm.

The diameter of the smoking article 100 is about 7.85 mm. The diameter of the frangible capsule 110 is about 4.2 mm. The diameter of the matrix bead 111 is about 3.5 mm.

The liquid composition is releasable in discrete amounts from the liquid delivery material 111 upon compressions of the liquid delivery material. In use, a mixture of the first and the second flavourant may thus selectively be formed to contact the mainstream smoke. Further, the relative proportion of the first and second flavourants in the mixture may be selectively adjusted.

The liquid core in the frangible capsule is released upon compression of the frangible capsule with a force of at least from about 5 Newtons to about 25 Newtons. After compression, the "mint" flavourant is available for release into the mainstream smoke as the smoke passes through the filter during smoking.

The liquid composition in the sustained-release delivery material is released upon compression of the material with a force of between about 1 Newtons and about 40 Newtons. After compression, the "floral" flavourant is available for release into the mainstream smoke as the smoke passes through the filter during smoking. The amount of "floral" flavour composition released from the sustained-release delivery material depends upon the applied compressive force such that the flavour intensity can be controlled through control of the pressure applied to the filter. The sustained-release delivery material can be compressed one or more times prior to or during smoking, and prior to or after effective compression of the frangible capsule in order to cause separate releases of "floral" flavour into the mainstream smoke. If both flavourants are released at the same time, the mainstream smoke contacts the second flavourant released from the matrix bead first and subsequently the first flavourant released in a single burst from the frangible capsule.

Examples illustrating in more detail how the combined release of the first and the second additive may impact the characteristics of the mainstream smoke and, therefore, the taste perception of the user during smoking are set out below.

EXAMPLE 1

Smoking articles according to the invention were assembled according to the first embodiment of the invention shown in FIG. 1. The frangible capsule contained 20 microlitres of "mint" flavourant diluted in MCT oil with mass ratio of 10:90 (w:w). The matrix bead contained 10 microlitres of "fresh" flavourant diluted in MCT with mass ratio of 10:90 (w:w). The "mint" flavourant composition contained mainly menthol. The "fresh" flavourant composition, on the other hand, contained a combination of menthol with other flavouring agents and flavour enhancers dosed such as to increase the "cooling" notes of the aroma.

The impact of the volume of flavourant released from the matrix bead on the burst of flavour delivered by the frangible capsule was evaluated by having trained panellists and flavourists describe sensory attributes such as note directions and taste sensations.

After the frangible capsule was ruptured, minty, green and herbal notes were identified, and fresh and cooling sensations were perceived.

When the matrix bead was compressed to deliver 10 percent to 50 percent of the volume of the "fresh" flavour in MCT, less minty and green notes were identified, whereas the intensity of the fresh and cooling sensation increased.

When the matrix bead was compressed to deliver 60 percent to 100 percent of the volume of "fresh" flavour in MCT, menthol, fresh and cooling sensations intensity increased which covered the minty notes.

Without being bound by theory, Example 1 illustrates that the flavourant released from the matrix bead combined with the flavourant released from the frangible capsule allows the consumer to modify the overall aroma direction (progressive decrease of the minty notes associated with the first flavourant contained in the frangible capsule), but also to modify the sensation perceived (progressive increase of the cooling/fresh sensation).

EXAMPLE 2

Smoking articles according to the invention were assembled according to the first embodiment of the invention shown in FIG. 1. The frangible capsule contained 20 microlitres of "mint" flavourant diluted in MCT oil with mass ratio of 10:90 (w:w). The matrix bead contained 10 microlitres of "citrus-mint" flavourant diluted in MCT with mass ratio of 10:90 (w:w). The "mint" flavourant composition contained mainly menthol. The "fresh" flavourant composition, on the other hand, contained a combination of menthol with other flavouring agents and flavour enhancers possessing green, citrus notes, such as those commonly associated with bergamot and other citrus oils.

The impact of the volume of flavourant released from the matrix bead on the burst of flavour delivered by the frangible capsule was evaluated by having trained panellists and flavourists describe sensory attributes such as note directions and taste sensations.

After the frangible capsule was ruptured, minty, green and herbal notes were identified, and fresh and cooling sensations were perceived.

When the matrix bead was compressed to deliver 10 percent to 50 percent of the volume of the "citrus-mint" flavour in MCT, minty, green and some citrus notes were combined inducing a change in the aroma direction. Additionally, the fresh and cooling sensation intensity increased.

When the matrix bead was compressed to deliver 60 percent to 100 percent of the volume of "citrus-mint" flavour in MCT, citrus and minty notes were perceived along with a substantial increase of cooling sensations.

Without being bound by theory, Example 2 illustrates that the flavourant released from the matrix bead combined with the flavourant released from the frangible capsule allows the consumer to enhance some aroma notes of the original flavour selected (the minty and fresh notes already present in the capsule flavour are "boosted" by the aroma compounds released with the second flavourant released from the matrix bead).

EXAMPLE 3

Smoking articles according to the invention were assembled according to the first embodiment of the invention shown in FIG. 1. The frangible capsule contained 20 microlitres of "mint" flavourant diluted in MCT oil with mass ratio of 10:90 (w:w). The matrix bead contained 10 microlitres of "jasmine" flavourant diluted in MCT with mass ratio of 10:90 (w:w). The "mint" flavourant composition contained mainly menthol. The "jasmine" flavourant composition, on the other hand, contained flavouring agents and flavour enhancers other than menthol and possessing floral notes, such as those commonly associated with fresh-cut flowers or blossoms (such as jasmine).

The impact of the volume of flavourant released from the matrix bead on the burst of flavour delivered by the frangible capsule was evaluated by having trained panellists and flavourists describe sensory attributes such as note directions and taste sensations.

After the frangible capsule was ruptured, minty, green and herbal notes were identified, and fresh and cooling sensations were perceived.

When the matrix bead was compressed to deliver 10 percent to 50 percent of the volume of the "jasmine" flavour in MCT, floral, jasmine, sweet and minty notes were perceived.

When the matrix bead was compressed to deliver 60 percent to 100 percent of the volume of "jasmine" flavour in MCT, a substantial increase in the floral notes was identified and increasingly fresh and cooling sensations were perceived.

Without being bound by theory, Example 3 illustrates that the flavourant released from the matrix bead combined with the flavourant released from the frangible capsule allows the consumer to substantially create a new flavour which is an addition/mix of the two flavours combined.

EXAMPLE 4

Smoking articles according to the invention were assembled according to the first embodiment of the invention shown in FIG. 1. The frangible capsule contained 20 microlitres of "coffee" flavourant diluted in MCT oil with mass ratio of 10:90 (w:w). The matrix bead contained 10 microlitres of "cocoa" flavourant diluted in MCT with mass ratio of 10:90 (w:w). The "coffee" flavourant composition contained flavouring agents that flavourists commonly associate with the aroma of freshly roasted or brewed coffee. The "cocoa" flavourant composition, on the other hand, contained flavouring agents other than those of the "coffee" composition and possessing notes that flavourists have defined chocolate- and cocoa-specific.

After the frangible capsule was ruptured, coffee, earthy, nutty notes were identified.

When the matrix bead was compressed to deliver 10 percent to 50 percent of the volume of the "cocoa" flavour in MCT, coffee, nutty, earthy and creamy notes were identified and sweet notes intensity increased.

When the matrix bead was compressed to deliver 60 percent to 100 percent of the volume of "cocoa" flavour in MCT, coffee, cocoa, cappuccino, creamy notes identified resulting in the perception of a new aroma.

Without being bound by theory, Example 4 illustrates that the flavourant released from the matrix bead combined with the flavourant released from the frangible capsule allows the consumer to substantially create a completely novel flavour which is the synergy of the two distinct basic flavours.

The invention claimed is:

1. A smoking article incorporating an additive delivery system, the additive delivery system comprising:

a frangible capsule comprising a breakable shell containing a liquid core comprising a first additive, wherein the shell can be broken by application of a pressure to release a single burst of the liquid core; and a sustained-release liquid delivery material comprising a liquid composition comprising a second additive, wherein the liquid composition is releasable in discrete amounts from the liquid delivery material upon compression of the liquid delivery material so as to selectively combine the first and the second additive, wherein the frangible capsule and the sustained-release liquid delivery material are spaced at least 10 mm apart in a longitudinal direction, such that a consumer can separately and selectively activate the release of the first additive from the frangible capsule and the second additive from the sustained-release liquid delivery material.

2. A smoking article according to claim 1, wherein the sustained-release liquid delivery material comprises:

a closed matrix structure defining a plurality of domains, the liquid composition being trapped within the domains.

3. A smoking article according to claim 1, wherein the first and the second additive are the same additive.

4. A smoking article according to claim 1, wherein the first and the second additive are different additives, the liquid composition being releasable from the liquid delivery material upon compressions of the liquid delivery material to vary the relative proportion of the combined first and second additives.

5. A smoking article according to claim 1, wherein the frangible capsule is a flavourant capsule, the first additive comprising a first flavourant mixed with one or more fats that are liquid at room temperature (22 degrees Celsius).

6. A smoking article according to claim 1, wherein the liquid delivery material is a flavour delivery material, the liquid composition being a flavour composition, the second additive comprising a second flavourant mixed with one or more fats that are liquid at room temperature (22 degrees Celsius).

7. A smoking article according to any of the preceding claims, wherein the frangible capsule is a seamless capsule.

8. A smoking article according to claim 7, wherein the seamless capsule has a crush strength of about 5 Newton to 25 Newton.

9. A smoking article according to claim 1, wherein the liquid delivery material provides a sustained release of the liquid composition upon compression of the material over a range of force of at least 5 Newton.

10. A smoking article according to claim 9, wherein the liquid delivery material provides a sustained release of the liquid composition upon compression of the material over a range of force from about 10 Newton to about 15 Newton.

11. A smoking article according to claim 1, wherein the volume of liquid core released upon rupture of the shell is from about 5 microliters to about 45microliters.

12. A smoking article according to claim 11, wherein the volume of liquid core released upon rupture of the shell is from about 10 microliters to about 20 microliters.

13. A smoking article according to claim 1, wherein the discrete amount of liquid composition released upon a single compression of the liquid delivery material is from about 1 microliters to about 10 microliters.

14. A smoking article according to claim 1, wherein the ratio of the total volume of liquid composition contained within the sustained-release delivery material to the total volume of liquid composition contained within the frangible capsule is between about 0.20 and 0.80.

15. A filter for a smoking article comprising an additive delivery system, the additive delivery system comprising:

a frangible capsule comprising a breakable shell containing a liquid core comprising a first additive, wherein the shell can be broken by application of a pressure to release a single burst of the liquid core; and a sustained-release liquid delivery material comprising a liquid composition containing a second additive, wherein the liquid composition is releasable in discrete amounts from the liquid delivery material upon compression of the liquid delivery material so as to selectively combine the first and the second additive, wherein the frangible capsule and the sustained-release liquid delivery material are spaced at least 10 mm apart in a longitudinal direction.

16. A filter according to claim 15, wherein the sustained-release liquid delivery material comprises:

a closed matrix structure defining a plurality of domains, the liquid composition being trapped within the domains.

17. A filter according to claim 15, wherein the first and the second additive are the same additive.

18. A filter according to claim 15, wherein the first and the second additive are different additives, the liquid composition being releasable from the liquid delivery material upon compressions of the liquid delivery material to vary the relative proportion of the combined first and second additives.

19. A filter according to claim 15, wherein the frangible capsule is a flavourant capsule, the first additive comprising a first flavourant mixed with one or more fats that are liquid at room temperature (22 degrees Celsius).

20. A filter according to claim 15, wherein the liquid delivery material is a flavour delivery material, the liquid composition being a flavour composition, the second additive comprising a second flavourant mixed with one or more fats that are liquid at room temperature (22 degrees Celsius).

* * * * *